United States Patent [19]

Haueise et al.

[11] 3,936,951

[45] Feb. 10, 1976

[54] METHOD OF AND APPARATUS FOR HEATING CIRCULATING AIR IN DRYING EQUIPMENT

[75] Inventors: Rolf-Richard Haueise, Bietigheim; Klaus Gäfgen, Hemmingen, both of Germany

[73] Assignee: Otto Dürr KG, Stuttgart, Germany

[22] Filed: Aug. 22, 1974

[21] Appl. No.: 499,584

[30] Foreign Application Priority Data

Aug. 24, 1973 United Kingdom ..... 40255/73

[52] U.S. Cl. ..... 34/35; 34/54; 34/86; 34/219; 34/242; 432/72; 23/277 C

[51] Int. Cl.[2] ..... F26B 3/00

[58] Field of Search ..... 34/35, 86, 242, 19, 72, 34/219, 225, 54, 32; 432/72; 431/328; 23/277 C, 277 R

[56] References Cited

UNITED STATES PATENTS

| | | | |
|---|---|---|---|
| 2,795,054 | 6/1957 | Bowen | 34/35 |
| 2,898,201 | 8/1959 | Hayes | 34/35 |
| 3,486,841 | 12/1969 | Betz | 34/35 |
| 3,604,824 | 9/1971 | Hardison | 432/72 |
| 3,752,642 | 8/1973 | Early et al. | 432/72 |

*Primary Examiner*—Kenneth W. Sprague
*Assistant Examiner*—James C. Yeung
*Attorney, Agent, or Firm*—Michael J. Striker

[57] ABSTRACT

In a method of and apparatus for heating circulating air, particularly circulating air in drying equipment, a portion of the circulating air is exhausted from the drying equipment and conveyed to a combustion chamber for the thermal incineration therein. Prior to entry into the combustion chamber, the exhaust portion of the circulating air is preheated by a transfer of heat with oxidyzed gases produced in the combustion chamber. Thereupon, an outlet channel conveys all or part of still-heated incinerated gases either directly to the remainder of the circulating air in the drying chamber, or indirectly to an air-lock, or alternatively to a heat exchanger to heat the remaining circulating air in the drying chamber. An intake and exhaust channel communicates with the outlet channel for allowing pollution-free air to enter the drying equipment to replace the portion of heated oxidyzed gases which has been discharged and to mix together with a portion of the heated incinerated gases so as to preheat the mixture thereby prior to entry into the drying chamber. Temperature sensor and flow control means cooperate so as to permit choice in selection of the path by which the exhausted portion of circulating air travels prior to entry into the combustion chamber through a preheat exchanger or by-pass.

16 Claims, 2 Drawing Figures

METHOD OF AND APPARATUS FOR HEATING CIRCULATING AIR IN DRYING EQUIPMENT

BACKGROUND OF THE INVENTION

The present invention relates to a method of and apparatus for heating circulating air and more particularly air which circulates in drying equipment by utilizing the thermal energy obtained in the process of thermal incineration or oxidation as a source of heat to preheat an exhausted portion of the circulating air and directly or indirectly supply heat to the remaining circulating air in the drying chamber; thus, maximizing the return of the thermal energy contained in the incinerated gases and fuel economy.

In the prior art, it is known to heat the circulating air in drying equipment and especially in automotive painting installations, so that the drying process may be accomplished in a short time period. A minimum drying time allows for substantial cost savings and for an efficient production line process. It is known to exhaust a portion of air from the drying equipment and direct it to a burner of a thermal incinerator, whereupon the heat of the incinerated gases is partially used to directly or indirectly heat the remainder of the circulating air in the drying equipment.

The disadvantage with the prior art method is that is does not utilize all of the thermal energy still potentially to be derived from the heated incinerated gases; because thus, of not using a preheat exchanger, making the prior art method costly and inefficient.

This disadvantage makes the prior art process expensive, difficult and cumbersome to carry out, and the apparatus unsuitable for production line techniques.

SUMMARY OF THE INVENTION

Accordingly, it is the general object of the present invention to overcome the disadvantages of the prior art.

More particularly, it is an object of the present invention to provide an improved method of and apparatus for heating of circulating air in paint-drying equipment or in other contexts in which circulating air must be heated.

It is a further object of the present invention to provide an improved method which efficiently utilizes the thermal energy contained in the incinerated gases by preheating the exhausted portion of the circulating air prior to entry into a combustion chamber.

It is a further object of the present invention to provide an improved method which transmits the thermal energy still contained in the incinerated gases, either directly or indirectly, back to the remaining circulating air in the drying equipment.

An additional object of the present invention is to provide a efficient pollution-reduction of a drying process.

A further additional object of the present invention is to provide an apparatus to make the process described easily feasible by using a heat exchanger in the preheating step.

In keeping with these objects and others which will become apparent hereinafter, the method according to the present invention of heating circulating air in drying equipment mainly comprises the steps of exhausting a portion of the circulating air from the drying equipment, circulating the exhausted portion of the air in a path into a combustion chamber to the thermal incineration therein, circulating the incinerated gases produced in the combustion chamber in another path in which the incinerated gases exchange heat with the exhausted air portion to preheat the same prior to entry thereof into the combustion chamber.

The step of exhausting a portion of circulating air from the drying equipment may include exhausting the said portion by means of a fan or a blower.

The step of circulating a portion of exhausted circulating air may include preheating the same in a preheater or a heat-exchanger. This feature overcomes the disadvantages of the prior art by efficiently utilizing the retained thermal energy of the incinerated gases. The exhausted air portion is preferably preheated to a temperature which is dependent upon the temperature of the circulating air. Temperature sensors are preferably located in or near the drying chamber to relay temperature data to flow control units which regualte the flow of the exhausted air portion. A bypass conduit with its own respective flow control unit cooperating with the temperature sensors is preferably positioned to provide an alternate path to bypass the preheater or the heat exchanger; thus, maximizing control of the drying process.

The apparatus needed to support oxidation in the combustion chamber may include a burner and a fuel source with its own associated flow controls to regulate the flow of fuel entering the combustion chamber. The flow controls preferably cooperate with temperature sensors positioned in or near the combustion chamber, so as to regulate the operation temperature of incinerator air.

The apparatus used for circulating the incinerated gases away from the preheater may include an outlet channel for further directing the path that the still-heated oxidyzed gases may be directed to one section of another heat exchanger having at least two sections each in heat-exchanging relationship with the other section, and whose second section surrounds a path through which the remaining circulating air travels, so as to exchange heat and thereby heat the remaining circulating air.

Alternatively, all or a part of the incinerated gases may be directed to an air-lock which, either directly or indirectly by means of another heat exchanger, heats the remaining circulating air inside the drying chamber.

Alternatively, all or a part of the heated incinerated gases may be directed directly back into the drying equipment.

Alternatively, all or a part of the heated incinerated gases may be mixed with incoming pollution-free air to preheat the mixture prior to entry into the drying equipment.

Alternatively, all or a part of the heated incinerated gases may be directed to a first section of a heat-exchanger having at least two sections each of which is in heat-exchanging relationship with the other section, and whose second section surrounds a path through which the incoming pollution-free air travels, so as to exchange heat and thereby preheat the incoming pollution-free air indirectly.

The above-mentioned feature of the alternative paths all overcome the prior art disadvantage of inefficient heat recovery and control of the drying process.

The apparatus used for circulating the incinerated gases may further include intake and exhaust valves, so as to insure that all pollutants are discharged to the outside atmosphere and that pollution-free air may replace any or all of the incinerated gases already discharged.

The drying chamber is preferably separate from the combustion chamber, and an additional feature of the present invention is that the separate drying chamber may be positioned contiguous to or in heat-exchanging relationship with the drying chamber so as to further heat by conduction the remaining circulating air. This feature of separate enclosures assures that no unwanted pollutants will be returned to the drying equipment.

As a further feature of the present invention, the flow control units use flap valves which are operative electrically by means of electric servomotors.

The novel features which are considered as characteristic for the present invention are set forth in particular in the appended claims. The invention itself, however, both as to its construction and its method of operation, together with additional objects and advantages thereof, will best be understood from the following description of specific embodiments when read in connection with the accompanying drawings.

DESCRIPTION OF THE PREFERRED EMBODIMENTS

Figure 1:
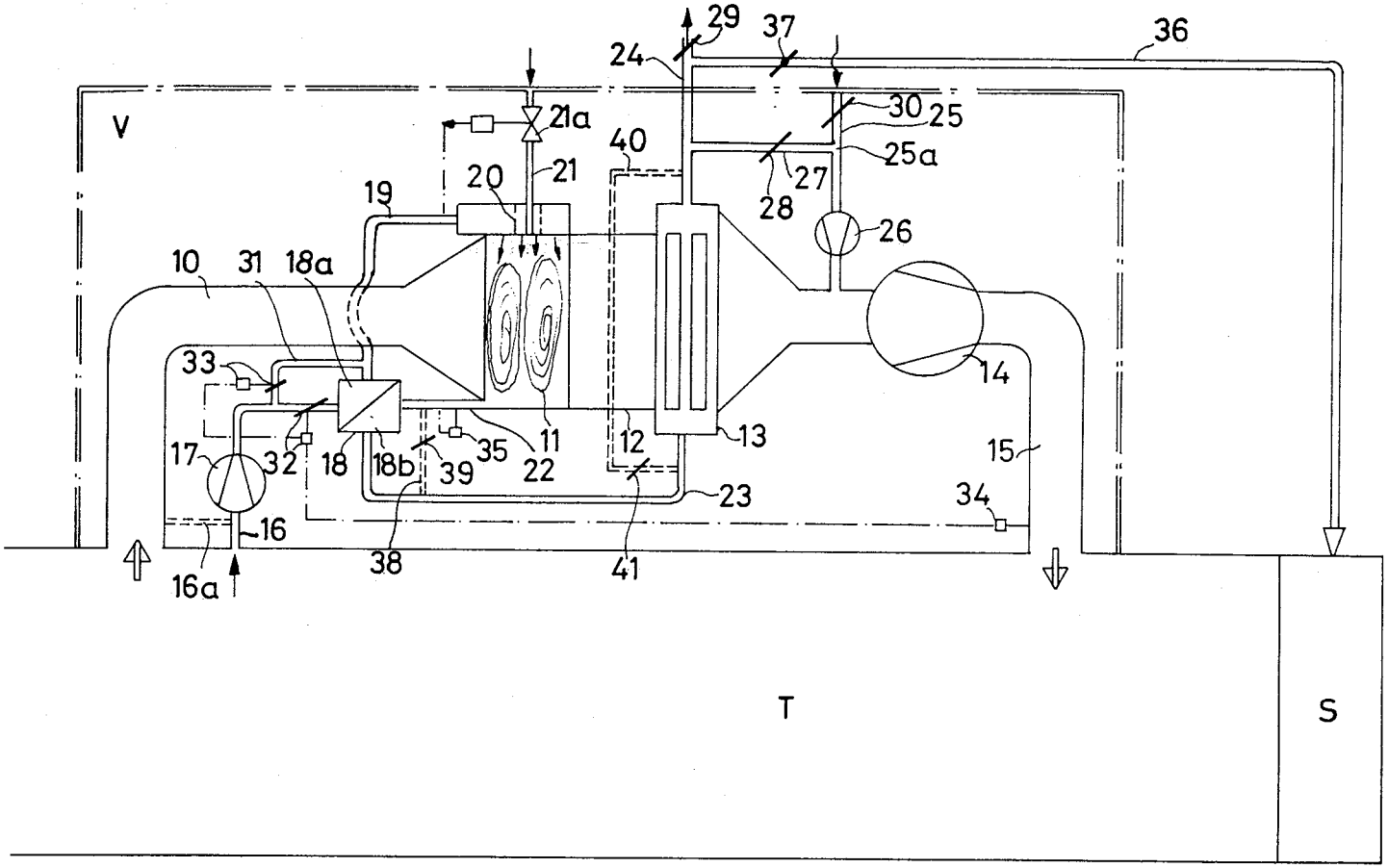
FIG. 1 is a diagrammatic vertical-section in schematic form of an apparatus according to the present invention.
Figure 2:
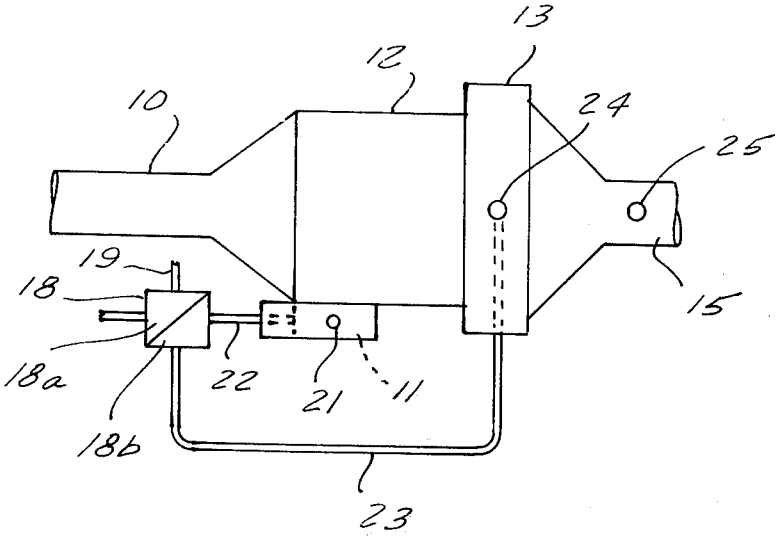
FIG. 2 is a diagrammatic top plan view in schematic for of a portion of the apparatus shown in FIG. 1.

Jointly discussing the apparatus of and the method for the present invention which has been illustrated in FIGS. 1 and 2 of the preferred embodiment, it will be seen that the drying equipment consists of a drying chamber T and an apparatus V mounted thereon. The circulating air from the chamber T passes through a pipe 10 to a portion 12 of the drying chamber T which accommodates a heat exchanger 13. The circulating air is thereupon returned to the chamber T by a fan 14 by way of a pipe 15.

A portion of the circulating air in the chamber T is exhausted by means of a fan 17 through a pipe 16. As an alternate path, pipe 16*a* located intermediate the pipe 10 and the pipe 16 may be used to direct the portion of exhausted air to the heat-exchanger 18, i.e. the preheater 18*a*. The heat-exchanger 18 has two sections; namely, the first part 18*a* and the second part 18*b*, each in heat-exchanging relationship with the other. The portion of exhausted air passed through the first part 18*a* by means of the pipe 16 where it is preheated by thermal energy exchanged from the second part 18*b*. Thereupon the preheated portion of exhausted air passes through the pipe 19 and the burner 20 and in turn to the combustion chamber 11, separate from the portion 12 of the drying chamber T as shown in FIG. 2, so as to support combustion therein.

Fuel is supplied to the combustion chamber 11 through the pipe 21 whose flow is controlled by the fuel control valve 21*a* located therein. The fuel control valve 21*a* cooperates with the temperature sensor 35 which is located in or near the pipe 22 which leads the heated incinerated gases away from the combustion chamber 11 to the second part 18*b* of the heat exchanger 18. When the temperature of the incinerated gases rises above a certain predetermined temperature, the fuel supplied to the burner 20 will be reduced by a partial or complete closing of the fuel control valve 21*a*. Of course, should the temperature of the incinerated gases decrease below a certain predetermined temperature, the amount of fuel supplied to the burner 20 will be dependently increased. In this manner, the temperature of incineration or oxidation can be kept as constant as required.

All combustible elements present in the combustion chamber 11 are oxidyzed, thereby producing the incinerated gases. The incinerated gases are conducted by means of the pipe 22 to the second part 18*b* of the heat exchanger 18, so as to exchange heat with the exhausted portion of circulating air present in the first part 18*a* prior to entry into the combustion chamber 11.

Subsequent to the heat exchange in the heat-exchanger 18, the incinerated gases are conducted away from the second part 18*b* by means of the pipe 23. Since the incinerated gases still retain useful thermal energy, the incinerated gases are led to one section of a heat-exchanger 13 having at least two sections, each in heat-exchanging relationship with the other; the other section of the heat-exchanger 13 surrounds a portion of the flow of the remainder of the circulating air conducted through the portion 12 of the drying chamber T, thereby heating said circulating air and returning thermal energy back to the drying chamber T.

The incinerated gases subsequent to exchange of heat in the heat-exchanger 13 may still be utilized to provide other possible heating functions prior to discharge to the outside atmosphere. If no further heating functions are desired, then the incinerated gases may be discharged through the pipe 24 by way of the opened valve 29 positioned therein.

In order to replace the exhausted portion of circulating air removed from the chamber T, pollution-free air enters the drying equipment by way of a pipe 25 and a fan 26 cooperating with the opened valve 30 positioned in pipe 25. The pollution-free air is added to the remaining circulating air downstream of the heat-exchanger 13 and upstream of the fan 14.

A connecting pipe 27 connects the pipe 24 to the pipe 25 and, by opening a valve 28 positioned in the pipe 27, and optionally by closing the valve 29 located in the pipe 36, the pollution-free air may be heated by the incinerated gases subsequent to the heat exchange in the heat exchanger 13 prior to addition to the remainder of the circulating air in the drying chamber.

A pipe 36 provided with a valve 37 leads from the pipe 24, to an air-lock S, or alternatively to a heat-exchanger (not shown). By closing the valve 29 located in pipe 24, and by closing the valve 28 in pipe 27, and by opening the valve 37, the heated combustion gases will flow to the air-lock S which is in heat-exchanging relationship with a portion of the chamber T. In this way, the retained thermal energy of the incinerated gases will subsequent to the heat-exchange by the heat-exchanger 13 heat the air-lock, and in turn heat the remaining circulating air in the drying chamber T. The air-lock may be provided with conduit and valve means (not shown) to allow the heated combustion gases to escape after the heat exchange has occured.

A pipe 31 bypasses the first part 18*a* of the heat exchanger 18. The flow control means 32 und 33 are positioned in or near the pipes 16 und 31 respectively in order to respectively close partly entirely either the pipe 16 leading from the fan 17 to the preheater 18*a* or the pipe 31. The flow control means 32 and 33 cooperate with the temperature sensor 34 which is positioned in or near the pipe 15 which returns a portion of the remaining circulating air back into the drying chamber T.

The flow control means 32 and 33 cooperate to insure that the temperature of the remaining circulating air remains as constant as possible. In case the temperature of the remaining circulating air falls, the flow control means 33 will open and the flow control means 32 will close, so that the amount of heat energy given by the incinerated gases to the exhausted portion of air in the preheater 18*a* will be reduced. As a result, an increased amount of heat will be available to heat the remaining circulating air in the heat exchanger 13. Of course, should the temperature of the circulating air rise, the operation of flow control means 32 and 33 will be just the opposite to that described above; and again the temperature of the circulating air will remain as constant as required.

A pipe 38 with a flow control valve 39 positioned therein bypasses the second part 18*b* of the heat exchanger 18. This arrangement provides for an optional control condition. In other words, if the temperature of the circulating air has reached a certain predetermined point and it therefore becomes unnecessary to preheat the exhausted portion of air, then valve 39 may be opened to allow the heated incinerated gases to bypass the heat exchanger portion 18*b* and go directly to pipe 23.

A pipe 40 with a flow control valve 41 positioned therein bypasses the heat exchanger 13. This arrangement provides for additional controllability and adaptability in creating the desired operating condition. In other words, if the temperature of the remaining circulating air has reached a certain predetermined point and it therefore becomes unnecessary to heat the remaining circulating air in the portion 12 of the drying chamber T, then the valve 41 may be opened to allow the incinerated gases to bypass the heat exchanger 13.

As a further feature of the present invention, the flow control means used throughout this system can utilize flap valves operative electrically by means of electric servomotors. In order to provide for simplification in the design of flow control means 32 and 33, a three-way valve unit can be employed as an equivalent structure.

As a further feature, the incinerated gases conducted through the pipe 27 by means of the opened valve 28 positioned therein may be directed to a heat-exchanger to be positioned at the junction 25*a*. The heat-exchanger shall have two sections, each in heat-exchanging relationship with the other, whose first section receives the incinerated gases and discharges the same to the outside atmosphere, and whose second section receives the pollution-free air through the pipe 25 and the opened valve 30 positioned therein, so as to indirectly heat the pollution-free air prior to entry into the drying chamber T without the incinerated gases being intermixed and unnecessarily polluting the remaining circulating air in the drying equipment.

It will be understood that each of the elements described above, or two or more together, may also find a useful application in other types of constructions differing from the types described above.

While the invention has been illustrated and described as embodied in a method of and apparatus for heating circulating air by preheating a portion of the circulating air, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention, and that therefore, such adaptations should and are intended to be comprehended within the meaning and range of equivalence of the following claims.

What is claimed as new and desired to be protected by Letters Patent is set forth in the appended claims:

1. In an apparatus for heating air, particularly circulation air in drying equipment or the like, a combination comprising a drying chamber containing circulation air; a combustion chamber separate from said drying chamber; first passage path means for circulation of a portion of the air from said drying chamber in a first path and into said combustion chamber; second passage path means including a heat-exchanger for circulating incinerated gases from said combustion chamber in a second path to said heat-exchanger in which said incinerated gases exchange heat with said air in said first path, so as to preheat said air in said first path prior to entry thereof into said combustion chamber; and third passage path means for circulating said incinerated gases from said heat-exchanger in a third path, so as to heat said remaining circulating air in said drying chamber, said third passage path means comprising means defining a conduit, pumping means, and a flow control means, said means defining a conduit forming a portion of said third path and conveying a portion of said incinerated gases to said drying chamber by operation of said flow control means cooperating with said pumping means.

2. An apparatus as defined in claim 1 said heat-exchanger having at least two sections, one of said sections surrounding a portion of said first path, and the other of said sections surrounding a portion of said second path and being in heat exchanging relationship with said one section.

3. An apparatus as defined in claim 2 and further comprising third passage path means for circulating said incinerated gases from said other section of said heat-exchanger in a third path, so as to heat said remaining circulating air in said drying chamber.

4. An apparatus as defined in claim 3, wherein said third passage path means comprises another heat-exchanger, means defining an alternate conduit, and flow control means, said other heat-exchanger having at least two sections, one of said sections surrounding a portion of said third path, and the other of said sections surrounding a portion of a path through which said remaining circulating air in said drying chamber is conducted and being in heat-exchanging relationship with said one section, said means defining an alternate conduit forming a portion of said third path and providing an alternate parallel path so as to permit said incinerated gases to bypass said one section of said other heat exchanger by operation of said flow control means.

5. In an apparatus for heating air, parituclarly circulation air in drying equipment or the like, particularly combination comprising a drying chamber containing circulation air, a combustion chamber separate from said drying chamber; first passage path means for circulating a portion of the air from said drying chamber in a first path and into said combustion chamber; second passage path means for circulating incinerated gases from said combustion chamber in a second path in which said incinerated gases exchange heat with said air in said first path, so as to preheat said air in said first path prior to entry thereof into said combustion chamber, said second passage path means comprising a heat-exchanger, said heat-exchanger having at least two sections, one of said sections surrounding a portion of said first path, and the other of said sections surrounding a portion of said second path and being in heat-exchanging relationship with said one section; and third passage path means for circulating said incinerated gases from said other section of said heat-exchanger in a third path, so as to heat said remaining circulating air in said drying chamber, said third passage path means comprising means defining a conduit, pumping means, and a flow control means, said means defining a conduit forming a portion of said third path and conveying a portion of said incinerated gases to said drying chamber by operation of said flow control means cooperating with said pumping means.

6. An apparatus as defined in claim 5, wherein said third passage path means further comprises intake means and discharge means, said intake means being operable to replace said incinerated gases removed by operation of said discharge means with outside ambient atmosphere; and wherein said intake means has means defining another conduit forming a portion of said third path and conveying a portion of said outside ambient atmosphere to said means defining the first-mentioned conduit so that said portion of said ambient atmosphere is mixed with said incinerated gases located in said means defining the first-mentioned conduit prior to entry thereof into said drying chamber.

7. In an apparatus for heating air, particularly circulation air in drying equipment or the like, a combination comprising a drying chamber containing circulation air; a combustion chamber separate from said drying chamber; first passage path means for circulating a portion of the air from said drying chamber in a first path and into said combustion chamber; second passage path means including a heat-exchanger for circulating incinerated gases from said combustion chamber in a second path to said heat-exchanger in which said incinerated gases exchange heat with said air in said first path so as to preheat said air in said first path prior to entry thereof into said combustion chamber; and third passage path means for circulating said incinerated gases from said heat-exchanger in a third path, so as to heat said remaining circulating air in said drying chamber, said third passage path means comprising means defining a conduit, and air lock, and a flow control means, said means defining a conduit forming a portion of said third path and conveying a portion of said incinerated gases to said air lock to heat the same by cooperation with said flow control means, and said air lock being separate from said drying chamber and being in heat-exchanging relationship with said remaining circulating air in said drying chamber.

8. In an apparatus for heating air, particularly circulation air in drying equipment or the like, a combination comprising a drying chamber containing circulation air; a combustion chamber separate from said drying chamber; first passage path means for circulating a portion or the air from said drying chamber in a first path and into said combustion chamber; second passage path means for circulating incinerated gases from said combustion chamber in a second path in which said incinerated gases exchange heat with said air in said first path so as to preheat said air in said first path prior to entry into said combustion chamber, said second passage path means comprising a heat-exchanger, said heat-exchanger having at least two sections, one of said sections surrounding a portion of said first path, and the other of said sections surrounding a portion of said second path and being in heat-exchanging relationship with said one section; and third passage path means for circulating said incinerated gases from said other section of said heat-exchanger in a third path, so as to heat said remaining circulating air in said drying chamber, said third passage path means comprising means defining a conduit, an air lock, and a flow control means, said means defining a conduit forming a portion of said third path and conveying a portion of said incinerated gases to said air lock to heat the same by cooperation with said flow control means, and said air lock being separate from said drying chamber and being in heat-exchanging relationship with said remaining circulating air in said drying chamber.

9. In an apparatus for heating air, particularly circulation air in drying equipment or the like, a combination comprising a drying chamber containing circulation air; a combustion chamber separate from said drying chamber; first passage path means for circulating a portion of the air from said drying chamber in a first path and into said combustion chamber, said first passage path means comprising exhaust means, a bypass conduit, and a flow regulation means, said exhaust means removing a portion of said circulating air from said drying chamber and directing said portion of exhaust air along said first path, and said flow regulation means comprising sensors and flow control means, said temperature sensors being located in said drying chamber and detecting the temperature of the remaining circulating air in said drying chamber, and said flow control means located in said first path and being valves regulating the flow of said portion of exhaust air to said combustion chamber by cooperating with said temperature sensors; and second passage path means for circulating incinerated gases from said combustion chamber in a second path in which said incinerated gases exchange heat with said air in said first path, so as to preheat said air in said first path prior to entry thereof into said combustion chamber, said second passage path means comprising a heat-exchanger, said heat-exchanger having at least two sections, one of said sections surrounding a portion of said first path, and the other of said sections surrounding a portion of said second path and being in heat-exchanging relationship with said one section, said bypass conduit defining a portion of said first path and providing an alternate parallel path so as to bypass said one section of said heat-exchanger.

10. In an apparatus for heating air, particularly circulation air in drying equipment or the like, a combination comprising a drying chamber containing circulation air; a combustion chamber separate from said drying chamber; first passage path means for circulating a portion of the air from said drying chamber in a first path and into said combustion chamber; and second passage path means for circulating incinerated gases from said combustion chamber in a second path in which said incinerated gases exchange heat with said air in said first path, so as to preheat said air in said first path prior to entry thereof into said combustion chamber, said second passage path means comprising a heat-exchanger, said heat-exchanger having at least two sections, one of said sections surrounding a portion of said first path, and the other of said sections surrounding a portion of said second path and being in heat-exchanging relationship with said one section, said second passage path means further comprising means defining a bypass path and a flow regulation means, said means defining said bypass path forming a portion of said second path and providing an alternate parallel path so as to bypass said other section of said heat-exchanger, and said flow regulation means having temperature sensors to detect the temperature of said incinerated gases and flow control means located in said means defining a bypass path which cooperates with said temperature sensors to regulate the flow of said incinerated gases past said other section of said heat-exchanger.

11. A process for heating air, particularly circulating air in drying equipment or the like, by using incinerated gases from a combustion chamber comprising the steps of exhausting a portion of said circulating air from aid drying equipment, circulating said portion of exhausted air from said drying chamber in a first path and into said combustion chamber, and circulating said incinerated gases from said combustion chamber in a second path in which said incinerated gases exchange with said portion of exhausted air in said first path, so as to preheat said portion of exhausted air in said first path prior to entry thereof into said combustion chamber, said step of circulating said incinerated gases including conducting said incinerated gases in a third path so as to heat said remaining circulating air in said drying chamber and conveying a portion of said incinerated gases directly into said drying chamber.

12. A process for heating air, particularly circulating air in drying equipment or the like, by using incinerated gases from a combustion chamber comprising the steps of exhausting a portion of said circulating air from said drying equipment, circulating said portion of exhausted air from said drying chamber in a first path and into said combustion chamber, circulating said incinerated gases from said combustion chamber in a second path in which said incinerated gases exchange heat with said portion of exhausted air in said first path, so as to preheat said portion of exhausted air in said first path prior to entry thereof into said combustion chamber, said step of circulating said incinerated gases including conducting said incinerated gases in a third path so as to heat said remaining circulating air in said drying chamber and conveying a portion of said incinerated gases to an air lock for indirect heating of said remaining circulating air in said drying chamber.

13. A process for heating air, particularly circulating air in drying equipment or the like, by using incinerated gases from a combustion chamber comprising the steps of exhausting a portion of said circulating air from said drying equipment, circulating said portion of exhausted air from said drying chamber in a first path and into said combustion chamber, and circulating said incinerated gases from said conbustion chamber in a second path in which said incinerated gases exchange heat with said portion of exhausted air in said first path, so as to preheat said portion of exhausted air in said first path prior to entry thereof into said combustion chamber, said step of circulating said incinerated gases including conducting said incinerated gases in a third path so as to heat said remaining circulating air in said drying chamber and exhausting a portion of said incinerated gases to the outside atmosphere, and intaking pollution-free air from the outside into said drying chamber and mixing said pollution-free air with said incinerated gases so as to preheat said pollution-free air prior to entry thereof into said drying chamber.

14. A process as defined in claim 13, wherein the step of circulating said incinerated gases in said second path further comprises the step of preheating said portion of exhausted air from said drying equipment in said first path to a temperature dependent upon the temperature of said remaining circulating air in said drying equipment.

15. A process as defined in claim 14, wherein the step of circulating said portion of incinerated gases in said second path further comprises the step of preheating said portion of exhausted air from said drying equipment in said first path by directing said incinerated gases to a heat exchanger, said heat exchanger having at least two sections, each of which is in heat-exchanging relationship with the other, one of said sections surrounding a portion of said first path, and the other of said sections surrounding a portion of said second path and being in heat exchanging relationship with said one section.

16. A process as defined in claim 13, wherein the step of circulating said incinerated gases in said third path conveys said incinerated gases to a heat exchanger having at least two sections, each of which is in heat exchanging relationship with the other, one of said sections surrounding a portion of said third path, and the other of said sections surrounding a portion of a path through which said remaining circulating air in said drying chamber is conducted and being in heat-exchanging relationship with said one section.

* * * * *